United States Patent [19]

Ernest et al.

[11] 4,399,582

[45] Aug. 23, 1983

[54] MODULAR INTERPROXIMAL TOOTHBRUSH SYSTEM

[76] Inventors: Raymond Ernest, 680 NE. 64th St., Miami, Fla. 33138; Stephen J. Ginsburg, 7 Lehigh Rd., Wellesley, Mass. 02181

[21] Appl. No.: 241,943

[22] Filed: Mar. 9, 1981

[51] Int. Cl.[3] ..... A46B 9/04; A46B 9/10

[52] U.S. Cl. ..... 15/176; 15/145; 15/167 R

[58] Field of Search ..... 15/167 R, 172, 176, 15/22 R, 23, 143 R–145; 206/362–362.2, 374, 375, 577, 461, 469, 471

[56] References Cited

U.S. PATENT DOCUMENTS

| | | | |
|---|---|---|---|
| 490,831 | 1/1893 | Lohers | 15/172 |
| 541,727 | 6/1895 | Dennis | 15/176 X |
| 3,065,480 | 11/1962 | Sexton | 15/172 |
| 3,072,944 | 1/1963 | Clayton et al. | 15/167 R |
| 3,978,852 | 9/1976 | Annoni | 15/167 R |
| 4,209,871 | 7/1980 | Ernest et al. | 15/167 R |
| 4,330,896 | 5/1982 | Booth | 15/176 |

FOREIGN PATENT DOCUMENTS

| | | | |
|---|---|---|---|
| 443435 | 9/1912 | France | 15/167 R |
| 216355 | 5/1924 | United Kingdom | 15/176 |
| 2035073 | 6/1980 | United Kingdom | 15/167 R |

*Primary Examiner*—Peter Feldman

*Attorney, Agent, or Firm*—Sherman & Shalloway

[57] ABSTRACT

A toothbrush system is provided wherein a plurality of disposable heads may be inserted onto a disposable stem, allowing the use of a wide variety of specialized heads on both manually operated and power toothbrush handles. The system permits the head and stem designs to be custom tailored to the individual patients' needs in terms of mouth size, brushing comfort, dental and periodontal needs, as well as convenience both at home and away from home. The modular system also permits the patient to clean his teeth in a more aseptic manner than would otherwise be possible.

1 Claim, 11 Drawing Figures

Fig. 1
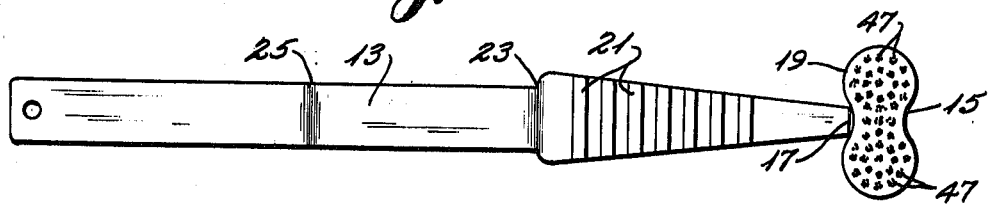
Fig. 2
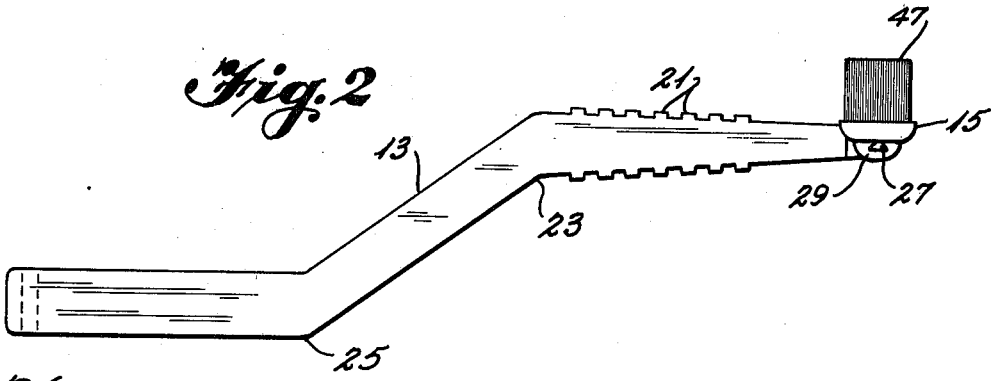
Fig. 3
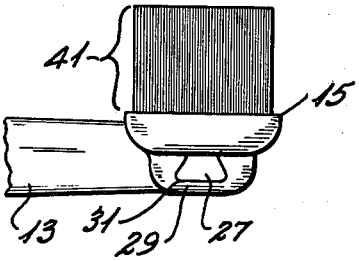
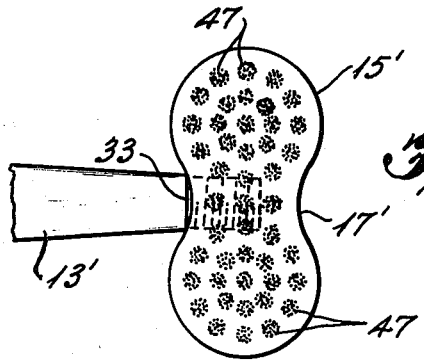
Fig. 4
Fig. 5a
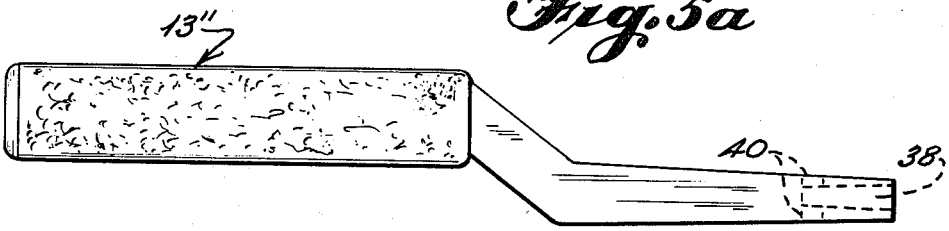
Fig. 8
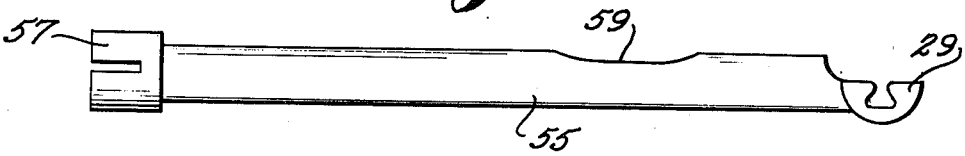

MODULAR INTERPROXIMAL TOOTHBRUSH SYSTEM

BACKGROUND OF THE INVENTION

1. Field of the Invention

This invention relates to toothbrushes, and more particularly to a system of providing toothbrushes of various configurations designed for improved cleaning of the mouths of a wide variety of individual patients in conditions of increased asepticity.

2. Description of the Prior Art

Throughout the years of teaching oral hygiene to be used in the home, the Dental Profession has generally recommended that a period of eight minutes is necessary with the use of the manual brush to debride the mouth as well as break up bacterial plaque.

With the use of a power toothbrush, this time can be reduced to a four-minute period with power movement.

However, both the power and manual techniques need the correct design of brush to enable it to enter the areas where the the majority of the problems occur in the oral cavity (interproximal areas).

It is currently recognized that while it is desirable with each brushing to remove as much bacterial plaque as possible from the interproximal spaces and from beneath the free gingival margin as well as from the surfaces of the teeth, the bacteria in the plaque which are responsible for tooth decay and gingival deterioration are inactivated for periods of time up to twenty-four hours by isolation of the bacteria from their grouping in a plaque form, that is, by disturbing the plaque formed on the teeth and breaking up the grouping of the bacteria. Accordingly, it is being urged that teeth be brushed in a rotary motion in an attempt to reach beneath the free gingival margin rather than in a reciprocating movement parallel to the occlusal plane and also by such rotary motion to avoid tooth structure erosion caused by reciprocating brushing.

Inasmuch as the structures of the toothbrushes currently available do not promote the use of the desired rotary brushing motion nor provide means to facilitate reaching into the interproximal spaces and beneath the free gingival margin, there is a present need to provide a toothbrush which will not only discourage brushing parallel to the occlusal plane and encourage as well as facilitate the desirable rotary brushing movement but will also provide means for reaching the interproximal spaces and beneath the free gingival margin.

Several proposals have been advanced to provide increased access to interproximal and free gingival margin areas of teeth. Significant among these is U.S. Pat. No. 4,209,871 to Ernest, that patent being hereby incorporated by reference. While the above-mentioned U.S. Pat. No. 4,209,871 discloses a toothbrush having a head which provides increased accessability to the teeth, the specialized nature of the brush head meant that it would be difficult to provide the brush in a wide variety of configurations. For example, a store would have to carry different stocks for various combinations of different manual and electrical toothbrush handles, as combined with bristles of various types, varying degrees of firmness and heads of various sizes. Thus, a patient having a relatively large mouth, a Broxident (T M) electrical toothbrush head and desiring soft rounded tipped natural bristles would probably not be satisfied with a small manually operated toothbrush having firm nylon bristles with shaved tips.

Additionally, a good home dental program may require the use of different toothbrush designs. For example, if a patient brushed twice daily, he may wish to use a brush which is adapted to maximize cleaning of gingival areas in the morning, and use a brush which maximizes cleaning of interproximal areas before he retires. In certain instances, a dentist may wish to prescribe the use of a certain type of toothbrush, such as a toothbrush designed to treat certain periodontal disorders.

While the primary function of a toothbrush is cleaning, toothbrushes are notoriously septic by their very nature. Macro- and microscopic particles are often lodged between bristles. Likewise, particularly in humid climates, the bristles tend to remain septically moist for long periods of time at room temperatures, often until the next use of the toothbrush.

People have used various techniques in order to avoid septic conditions. In addition to vigorously rinsing the toothbrush before and after each use, people often use multiple toothbrushes, permitting a longer period of inactivity to exist between uses of a particular toothbrush. Septic conditions have also discouraged the use of toothbrush designs in which large amounts of bristles are used because these large amounts of bristles makes it difficult to obtain dry condition of the toothbrush head.

Various disposable toothbrush designs have been advanced in the prior art. Notable among these is U.S. Pat. No. 4,227,276 to Ginsburg, et al., invented in part by one of the co-inventors of the present invention; that patent being hereby incorporated by reference.

The above-mentioned U.S. Pat. No. 4,227,276 discloses the use of a removable handle which may be re-formed when heated in hot water. This presents a partial solution to another problem in the prior art, that is the custom tailoring of toothbrush handles to the individual user.

While particular shapes of toothbrush handles may be more desirable, it may be also desirable to provide toothbrush handles which may be of particular highly specialized or expensive variety with the brushes being disposable.

It may also be desired to provide toothbrushes with handles which would be used for a variety of user applications. For example, if a user desired to use a toothbrush while spending the night away from home, she may wish to have the convenience of portability. She may also wish to have the convenience of using a particular toothbrush head configuration. If she is visiting someone whom she knows has an electric toothbrush handle, she may wish to have a handle which, if circumstances allow, permit her to attach her toothbrush to the electric toothbrush handle in conditions which are reasonable aseptic.

U.S. Pat. No. 3,994,039 discloses various methods for brushing teeth, that patent being hereby incorporated by reference. These methods include various combinations of back-and-forth movement and vertical brush movement designed to effectively clean the teeth and provide circulation at the gingival margin. In a similar matter, electric toothbrushes have been designed to provide various brush movements, primarily in an attempt to provide brushing action recommended by dentists. These include, in addition to vertical and horizontal movements, vertical rolling movements and combinations of horizontal and rolling movements.

Recently, a short circular movement has received widespread acceptability in the dental profession. These diverse movements have been generally designed to be used with a single brush, usually having a simple rectangular or round shape, with little attention to improving brush design as well.

SUMMARY OF THE INVENTION

It is accordingly an object of the invention to provide a system for permitting the use of an improved toothbrush design in a variety of dental applications, including electric toothbrushing, with specially constructed handles, and in a wide variety of toothbrushing environments including in environments away from home.

It is a further object of the invention to provide a system for improved dental hygene in which an improved head is used which may be readily replaced either with a different head or with a clean head.

It is a further object of the invention to provide a toothbrush system wherein an improved brush head may be detachably attached to a handle to provide various angles and positions to the head relative to the user's hand grip. For example, one could turn the brush head on the handle 180° so that eather a left- or right-handed user could get full use of the brush. This enables people with severe minimal dexterity problems, such as arthritic, elderly or handicapped people, etc. to use the brush with either their left or right hand.

It is a further object of the invention to provide a toothbrush with an improved head to be used with a wide variety of stem holders including manually-operated stem holders, electrically-operated stem holders, portable stem holders and stem holders which may be operated either alone by hand manipulation or be attached to an electric toothbrush handle.

It is a further object to provide a wedging toothbrush head configuration which is made more acceptable by decreasing bristle stiffness at those points of primary contact with the gingival border area of the gums and teeth.

It is a further object to provide a wedging toothbrush which is more acceptable to the patient because he can interchange the wedging brushhead with a conventional head.

Yet a further object of the invention is to provide a toothbrush construction having bristles shaped, sized, located and flexible for reaching into the interproximal spaces and under the free gingival margins and which will be particularly adapted for penetrating those relatively inaccessible areas of the molars and bicuspids from the lingual cavity and the buccal cavity where the accumulations of the plaque is relatively heavy, and promoting the desirable rotary brushing motion while enabling the teeth of both the maxillary and mandibular arches to be brushed simultaneously, while avoiding excessive abrasion to the teeth and gums.

In one aspect, this invention contemplates a stem which extends from a handle and has a leading end section terminating in an attachment means for attaching an elongated bristle bearing head having a major axis perpendicular to the longitudinal axis of the stem section. The bristle bearing head is formed as a back having a flat surface from which a plurality of embedded bristles project in a predetermined arrangement which is bilaterally symmetrical with respect to the transverse minor axis of the head. The bristle arrangement, which may be clustered in a plurality of tufts, includes wedge-like configurations of such tufts having one of the tufts located as an apex adjacent each opposite end of the back. The length of the head along the major axis spaces the bristles comprising the apices a distance apart to facilitate penetration into the interproximal spaces and free gingival margins of the teeth of both the maxillary and mandibular arches simultaneously when the stem, through handle and manipulation, is disposed along the occlusal plane with the mouth in an open, teeth brushing position. The tuft forming the apex of the wedge-like configuration is centrally located with respect to the rounded end of the head on the major axis, or, where the ends of the head are tapered, the tuft forming the apex is located along the trailing or leading side edges of the head. The slope of the wedge-like configuration away from each apex conforms to the scallopped contour of the gingival edges thereby improving the ability of the bristles to penetrate beneath the free margins thereof while improving the ability of these bristles at the apices to penetrate into the interproximal spaces at the gumline.

An area of bristles adjacent the transverse minor axis of the head may be cut to a shorter length than those bristles located toward the opposite ends of the head including the bristles in the wedge-like configuration of tufts in order to facilitate the flexing of the latter in achieving their hereinbefore described intended simultaneous penetration.

A modified hourglass shaped head provides additional wedge-like configurations of bristles and tufts spaced apart along the leading and trailing side edges of the head between gingival margin penetration when the major axis of the head is held parallel to the occlusal plane to render an additional capability to the toothbrush which is particularly useful in cleaning the front teeth.

Three other styled heads are also provided: A normal rectangle with semi-circled ends; wedge and reverse wedge configurations; and a gum massaging head.

The bristles from a frontal view also show a gentle curvature from the center to approximately the fourth row of bristles. The take-apart attachment means may be designed as a fraction grip, bolt action, screw action, clip action, slide or lock action. This attachment of head to handle may also be designed so that it can be turned 180° and then inserted into the handle or vice versa thus reversing the angle of the handle.

Accordingly, in another aspect, this invention contemplates a toothbrush construction for improved accessability to the interproximal and free gingival margins of teeth having at least one head having an hourglass profile and including a wedge-like configuration having apices at opposite ends, a stem which may be attached and detached from the head at a location near the narrow portion of the hourglass profile (between the apices), so that the head can be readily removed and replaced with another head having either the same hourglass configuration or another configuration. Stems of different varieties may be substituted for the stems so that the toothbrush may be used with a power toothbrush handle or in a manually-operated mode.

In a further aspect of the invention, a toothbrush of the type having an hourglass configuration with bristles having apices extending from opposite ends of the hourglass at a stem extending from a center portion of the hourglass was improved by providing a detachment means for the bristle-bearing head, thereby permitting the changeability of the head for increased asepticity and for the use of a large variety of heads and stems.

In a further aspect of the invention, a modular toothbrush system is provided wherein a large variety of the stems are selectively attachable to a plurality of brush heads, at least one of the heads having an hourglass profile, so that the user may select different heads in accordance with his different needs and arrange the heads in order to maintain aseptic conditions when brushing.

BRIEF DESCRIPTION OF THE DRAWINGS

FIG. 1 shows a top view of a preferred embodiment of the invention, using a manually-operated handle.

FIG. 2 is a side view of the embodiment shown in FIG. 1.

FIG. 3 shows details of a slide-type head attachment means according to one aspect of the present invention.

FIG. 4 shows details of a screw-on attachment means according to another aspect of the present invention.

FIGS. 5*a* and 5*b* show an alternative embodiment according to the present invention of a stem and brush head, respectively.

FIG. 8 shows a stem according to the present invention which may be either manually manipulated or used with an electric toothbrush handle.

DETAILED DESCRIPTION OF THE PREFERRED EMBODIMENTS

Figure 5B:
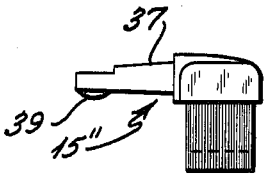

Referring to FIGS. 1–3, the basic configuration of the toothbrush construction according to the invention comprises stem portion 13 which is attached a brush head 15 and is removably attached to the stem portion 13, as will be later described. In the preferred embodiment, the brush head 15 is provided with an hourglass configuration, having a narrowed portion 17 between two widened portions 19. The stem portion 13 extends from the narrowed portion 17, thereby forming a more-or-less perpendicular arrangement between the brush head 15 and the stem 13.

The stem 13 may be provided with various arrangements to facilitate brushing. In the embodiment shown, a series of ridges 21 facilitate gripping of the stem 13 near the brush head 15. The brush head 15 is also formed with an offset by bending downward at a forward bend 23 and back upward at an aft bend 25.

Referring to FIG. 3, the brush head 15 is provided with an attachment portion 27 which mates with a corresponding attachment portion 29 on the stem 13. These attachment portions 27, 29 join each other at interface 31.

It is possible to connect the stem-brush portions with a threaded connection means, as shown in FIG. 4, where a stem portion 13' has a stud 33 extending into a brush head 15' at a narrowed portion 17' thereof. The brush head 15' receives the stud 33 by way of a threaded hole 35.

Referring to FIGS. 5*a* and 5*b*, a socket connection may be used to connect a stem 13" with a brush head 15". This arrangement is particularly easy to manufacture out of plastic. In this embodiment, the brush head 15" has a male extension 37 which is received by socket 38. A protrusion 39 on the male extension 37 snaps into one of two opposed holes 40 to retain the brush head 15" in position on the stem 13". By providing two opposing holes 40, the brush head may be placed in two positions, 180° apart.

Referring again to FIG. 3, the method of attaching brush head 15 to stem 13 may also be by means of snapping. In this case, the materials of the brush head 15, and particularly the attachment portion 29 of the stem 14 will be made soft and elastic. This would permit the user to snap brush head 15 into stem 13 without using a sideways sliding motion.

Figure 6:
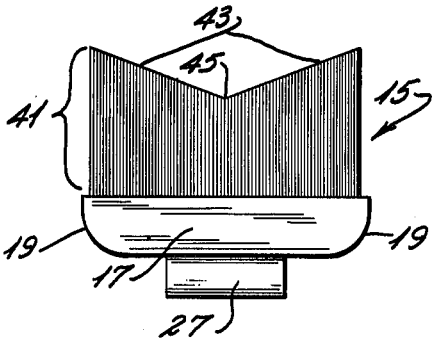
FIG. 6 is an end view showing the brush configuration of the brush head according to the preferred embodiment.

Referring to FIGS. 1 and 6 in the preferred embodiment, the brush head 15 is formed with its bristles 41 having two apices 43 extending from the widened portions 19, and a depressed section 45 extending from the narrowed portion 17. This permits an improved access to gingival margins and the adjacent tooth surfaced as well as the interproximal areas, thereby relying upon the construction of the brush rather than the brushing technique for massage and cleaning in these areas.

The brush configuration enables an individual user to reach into the interproximal spaces and free gingival margins. Moreover, this brush enables the user to choose between cleaning the upper and lower teeth simultaneously, particularly at the back of the arch or of cleaning the upper and lower teeth separately. In this approach to brushing, the apices 43 are properly located to enable the user to quickly alternate between the upper the lower teeth. Thus, the brush enables the user to break up the bacterial plaque in the interproximal spaces and under the free gingival margins. By the bacteria being broken up it is inactivated for a twenty-four-hour period, for the prevention of dental caries and gingival diseases.

The general shape of the head 15 is that of an hourglass figure, consisting of more bristles in the widened areas 19, corresponding to the maxillary and mandibular gingival areas of a patient's teeth.

In the preferred embodiment of the "average size" head, the widened portions 19 have a measurement of 14 mm. The narrowed portion 17 of the hourglass has a measurement of 10 mm. The total width of the head 15 is 24 mm. The widened portions 19, corresponding to the gingival regions, are comprised of three vertical rows of bristle tufts. The narrowed portion 17 comprised of three vertical rows of bristle tufts also. The width of the widened portions 19 comprises rows of four tufts each, following the curvature of the hourglass form. The narrowest portion (i.e. middle portion) is comprised of rows of three tufts each. The widened portions 19 have a bristle tuft length of 10 mm. The narrowed portion 17 has 8 mm tufts.

In the preferred embodiment of the manually operated toothbrush's stem 13, the overall length of the lateral plane is 130 mm and exhibits an outline form extending away from the attachment point 29 for the head 15 running horizontally 50 mm and then flowing upward, ending at its highest point at approximately 35 mm and continuing at this 35 mm height in a horizontal direction to its ending dimension. This stem 13 may be offered in stainless steel or plastic.

Referring to FIGS. 1 and 4, in order to reduce the abrasive effect of the toothbrush on the teeth and gums, certain bristles 47 are chosen as primary contact bristles. These primary contact bristles 47 are at the perimeter of the brushing surface at the apices 43 and are therefore most likely to contact the surfaces of the teeth and gums prior to the remainder of the bristles 41. If the stiffness or the modulas of elasticity of all bristles 41 is the same, then the primary bristles 47 would therefore be most likely to exert the highest forces on the patient's mouth, thereby causing the primary contact bristles 47 to exert an abrasive affect which is equivalant to that of a bristle in the depressed section 45 which is significantly firmer.

In order to increase the mildness of contact for any given bristle thickness, the primary contact bristles 47 are made softer than the remaining bristles, as set forth in the following example:

EXAMPLE

A nylon bristle toothbrush having the "Vee" configuration of FIG. 5 is made with nylon bristles, the majority of which has a thickness of 0.25 mm. In order to reduce the abrasive qualities of the bristles on the area of the free gingival margins, the primary contact bristles 47 are made with the thickness of 0.20 mm.

Figure 7:
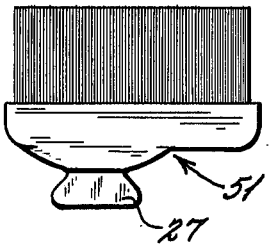
FIG. 7 shows a brush head having a conventional brushhead configuration for use with the modular system of the present invention.

In cases where a patient may be reluctant to completely switch to a new type of brush head, he is able to obtain a brush head having a conventional design 51 as shown in FIG. 7. As can be seen, the conventional design brush head 51 is also provided with a head attachment portion 27 which is identical to the attachment portion 27 of the preferred hourglass brush head to the attachment portion 27 of the preferred hourglass brush 19. It can be readily seen that, by providing the identical attachment portion 27 and otherwise providing for proper clearance between the conventional design brush head 51 and the stem 13, the conventional design brush head 51 may be used with stem 13.

It can be readily seen that, in addition to our hourglass design brush heads, such as brush head 15 and conventional design brush heads such as brush head 51, a wide variety of attachments may be used in accordance with the present invention. For example, a gum-massaging head (not shown) of the type having rubber bristles may be provided with this system. Other attachments are also possible, such as flosser attachment (not shown).

Since the brush head, such as brush heads 15 and 51 may be separated from the stem 13, it is possible to frequently replace with the brush heads 15, 51. By providing new brush heads 15, 51 at frequent intervals, not only are more expensive designs of the stem 13 possible, but the user may be assured of the use of a clean brush head at all times. This permits, not only the use of a preferred design of the brush head, such as brush head 15 by the patient on a trial basis, but also permits improved cleaning of the teeth under more sanitary conditions.

Referring to FIG. 8, a stem 55 is provided for mounting to an electric toothbrush handle (not shown). Stem 55 has an attachment portion 29 which is identical to the attachment portion on stem 13. This permits the interchangeability of stems 13, 55 with brush heads 15, 51. Stem 55 is provided with a mating fitting 57 which mounts to the moving end of the particular toothbrush handle in which stem 55 is designed.

A serrate recess 59 permits the use of stem 55 at places where the electric toothbrush head is not available or cannot be plugged into a suitable source of electrical power. However, it can be readily seen, that by using stem 55, the user does not need to purchase an entire toothbrush head specifically for the use with the electric toothbrush. This is important, particularly in cases where the user does not want to, for social reasons, indicate that an entire toothbrush was purchased for use with another person's toothbrush handle.

Figure 9:
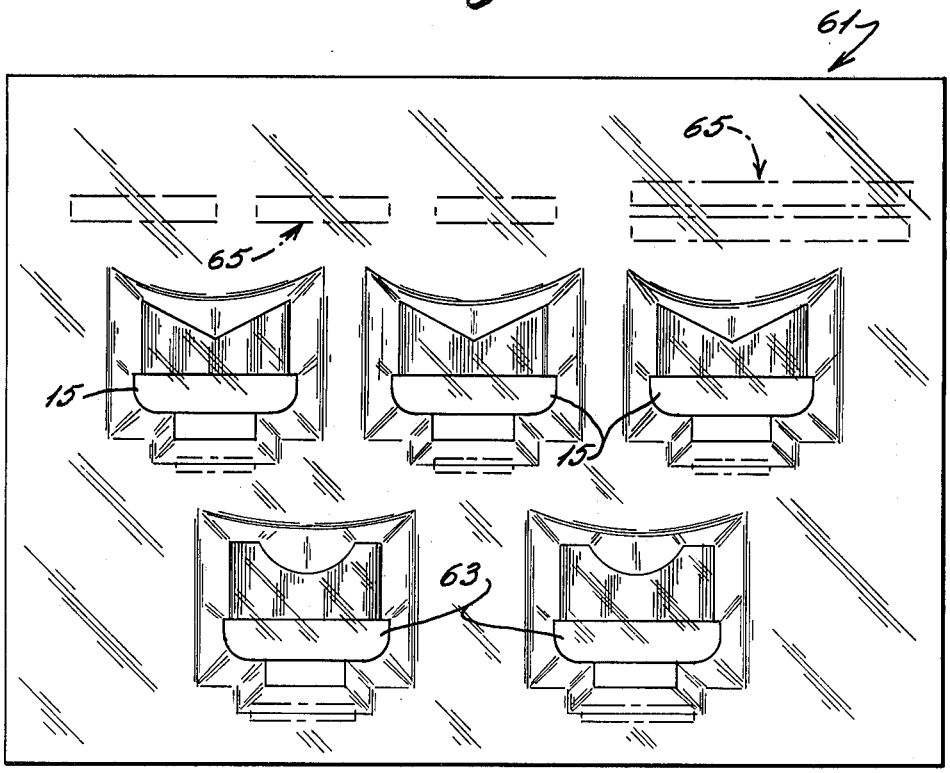
FIG. 9 shows a package containing a plurality of brush heads in accordance with the present invention.

Referring to FIG. 9, brush heads may be provided in a conventional blister package 61, separately from the stem. In the package 61 shown, two styles of brush heads 15, 63 are shown; however, the bristle construction is specific to a particular choice of the patient. Indicia 65 of the package indicates that the bristles 41 are of that specific construction, facilitating selection at point of purchase. Since the brush heads may be placed on any of a number of stems, the patient is not further limited by his choice of stems.

By providing disposable brush heads, the user is able to eliminate the need for carrying a tube of toothpaste. Particularly during travel, the toothpaste can cause problems of inconvenience, even where a toothpaste does not leave its tube while it is still in the user's suitcase. To this end, toothpaste may be provided with the brush heads, as implied by the indicia 65 in FIG. 9.

While the invention has been described in terms of these specific embodiment shown, it is clear that various modifications can be made to the present invention. For example, the embodiment of FIG. 4 is intended to also be useful with the conventional designed toothbrush head or with a stem to fit an electric toothbrush.

Figure 10:
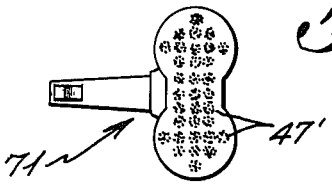
FIG. 10 shows an alternate brush pattern for the brush head according to this invention.
Figure 11:
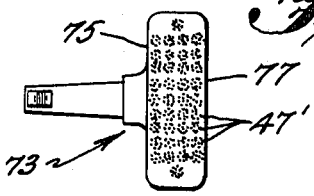
FIG. 11 shows a brush head according to the invention having an equal width between the apices.

As stated above, the preferred interproximal brush head should not be limited to the configuration of brush head 15 in FIGS. 1–4. Referring to FIGS. 10–11, wedging type heads 71, 73 may be constructed with primary contact bristles 47' extending across four rows in the apices in a variety of tuft patterns, according to convenience of manufacture. Additionally, referring to FIG. 11, by providing a reduced thickness for the primary contact bristles 47' at apices 75, intermediate bristles 77 between the apices may be provided without a narrow tuft configuration. This will still provide for improved contact with interproximal spaces and gingival areas, as brush heads 71, 73 will have the profile of brush heads 63 (FIG. 9), providing brush heads 71, 73 with a wedging effect.

What is claimed:

1. A toothbrush construction having the capability for simultaneously penetrating the innerproximal spaces and the free gingival margins of the teeth of both the maxillary and the mandibular arches comprising:

(a) at least one elongated bristle bearing head having a major axis extending between opposite ends of said head, said bristle-bearing head comprising a back having a substantially flat surface, a plurality of bristles projecting from said flat surface in a predetermined arrangement bilaterally symmetrical with respect to a minor axis of the head, the predetermined bristle arrangement including a wedge-like configuration having an apex located adjacent each of the opposite ends, the bristles around the perimeter of said bristle-bearing head at the apices having a thickness which is less than the average thickness of the remainder of the bristles in order to reduce the firmness and abrasive qualities of these bristles;

(b) a means for detachably attaching the head to a stem, the stem having a longitudinal axis and first and second straight end portions spaced apart and in parallel and connected by an angularly disposed straight middle portion, the attachment being disposed at the distal end of said first straight end portion so that when the head is attached to the stem, the stem's longitudinal axis is coaxial with respect to the minor axis of the head, the first straight end portion of said stem being provided with a series of ridges to facilitate gripping of the stem near said head;

(c) a mid portion of the head located between the apices, the length of the mid portion along the major axis being such as to position each apex at the gingival margin at each of the edges when the mouth is at an open position and the stem disposes the longitudinal apices in the occlusal plane, wherein the head can be readily removed from the stem and replaced with other heads having either the same configuration or a different configuration.

* * * * *